US006853818B2

(12) United States Patent
Nishida

(10) Patent No.: US 6,853,818 B2
(45) Date of Patent: Feb. 8, 2005

(54) FIXING DEVICE INCLUDING PHASE CONTROL AND WAVE NUMBER CONTROL

(75) Inventor: Yoshiaki Nishida, Hamura (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/267,870

(22) Filed: Oct. 10, 2002

(65) Prior Publication Data

US 2003/0072581 A1 Apr. 17, 2003

(30) Foreign Application Priority Data

Oct. 11, 2001 (JP) ..... 2001-314510

(51) Int. Cl.[7] ..... G03G 15/20
(52) U.S. Cl. ..... 399/67; 399/69
(58) Field of Search ..... 399/67, 69, 31, 399/88, 90; 323/237, 241, 245; 219/216

(56) References Cited

U.S. PATENT DOCUMENTS 3,937,921 A * 2/1976 Furuichi et al. ..... 219/216
5,669,038 A * 9/1997 Kishimoto ..... 399/67
5,994,671 A * 11/1999 Suzuki et al. ..... 399/69
6,177,657 B1 * 1/2001 Takata ..... 219/216
6,301,454 B1 10/2001 Nishida et al. ..... 399/69

FOREIGN PATENT DOCUMENTS

JP 11-95611 4/1999
JP 2000-237162 9/2000

* cited by examiner

*Primary Examiner*—Arthur T. Grimley
*Assistant Examiner*—Ryan Gleitz
(74) *Attorney, Agent, or Firm*—Fitzpatrick, Cella, Harper & Scinto

(57) ABSTRACT

A fixing device includes a fixing heater for being supplied with an AC voltage to generate heat; control means for variably controlling power of supplied electric energy to the fixing heater, wherein one cyclic period for changing the electric power comprises a plurality of waves, and the one cyclic period including a portion in which an electric power supply phase is changed and a portion in which a number of waves of the electric power supply is controlled.

5 Claims, 10 Drawing Sheets

FIXING DEVICE INCLUDING PHASE CONTROL AND WAVE NUMBER CONTROL

FIELD OF THE INVENTION AND RELATED ART

The present invention relates to a fixing device for use with an image forming apparatus such as a copying machine, printer or the like using an electrophotographic type or electrostatic recording type process. An addition heat fixing type is widely used for a fixing device in the image forming apparatus, and the heater of the heat-fixing device uses a halogen lamp which requires a relatively high consumption current. Upon actuation thereof, a large current such as an inrush current flows, with the result of large current variation.

FIG. 1 shows a general fixing roller. The fixing roller comprises a heater roller 1 containing a heater 4 therein, and a pressing roller 2 urged to the heater roller 1. By passing a sheet 3 between the rollers 1, 2, the toner image is fused on the sheet 3. In order to detect the temperature of the heater roller 1, there is provided a thermister 5 (temperature sensor).

FIG. 2 shows a heater electric power supply current waveform in a conventional ON/OFF control for temperature adjustment of the heater roller 1. In the waveform, portions P1 and P2 indicate portions of abrupt current change corresponding to points of switching between OFF state and ON state. The current variation produces a voltage variation of the supply AC voltage source itself, with the result of flickering of illumination or the like which is energized by the same voltage source. More particularly, as shown in FIG. 4, there is, in general, a relatively small voltage source impedance Rs, as the voltage is seen from the outside an electrical outlet of the voltage source. Therefore, when the consumption current of the connection equipment (copying machine) D to the voltage source AC significantly and abruptly changes, the power source voltage changes due to the voltage drop through the voltage source impedance Rs. When the abrupt change of the current is δI, the abrupt variation minute δV of the power source voltage is as follows:

$$\delta V = Rs \times \delta I$$

For example, if an illumination device L is connected with the electrical outlet line, the abrupt power source voltage variation causes flickering of the illumination, It is desired to reduce the power source voltage variation due to abrupt current change.

In order to reduce the abrupt current change (reduction of the flickering value) due to the halogen heater used with the fixing device in a copying machine or the like, the abrupt current change portion at the ON or OFF portion P1, P2 of the halogen heater power supplying current is required to be mitigated.

One of the conventional methods to accomplish this is to control the electric power supply to the heater using a phase control (conduction angle control) as shown in FIG. 3. As described in the foregoing, in order to prevent an abrupt current change as in the case of the generation of the abutment entering current immediately after actuation of the heater, the applied voltage is gradually, in effect, increased. For example, the electric power supply time in each of the half wave of the AC power source voltage is first set at a small level, and it is gradually increased (t1, t2, t3 . . . tn), in accordance with a heater electric power supply current waveform as shown in FIG. 3.

It is possible to provide a gradual current change. However, the conduction of the heater begins not at the zero-cross starting point but in the middle of the half wave, therefore the harmonic current and the contact noise in the voltage source line is not avoidable.

As a method for solving the problem, Japanese Patent Application No.2000 237162 discloses a wave number control proposed by the inventors of the subject application. In this method, a skipping control is effected with unit three waves, with which the electric power supplying current can be selectable from four stepwise levels. With this method, it is possible to reduce the harmonic current and/or the contact noise appearing in the voltage source line. In addition, the flickering could be reduced to a certain extent.

FIG. 10 shows this method.

As shown in the Figure, (a), four boundary temperature values TMPa, TMPb, TMPc (TMPa>TMPb>TMPc) at which the electric power supply pattern is switched in each of the unit cyclic period, and the electric power supply patterns are assigned to the rep temperature ranges as shown in the Figure at (c). As shown in the Figure, (a), when the temperature changes sequentially in the increasing order, namely, TMPc, TMPb, TMPa, and then changes in the decreasing order, namely, TMPa, TMPb, TMPc, the electric power supply pattern changes in the order of 3/3, 2/3, 1/2, 0/3, 1/3, 2/3, 3/3. The temperature of the fixing roller relatively gradually changes, and therefore, the voltage applied to the heater has stepwisely different electric power supply pattern.

With this method, the change in the current changes with increment of 1/3 of full power supply, and therefore, it is effective from the standpoint of reduction of the flickering value. However, this is not sufficient. However, the usable electric power supply levels are four, and in order td increase the number of levels, it is necessary to increase the number of waves.

SUMMARY OF THE INVENTION

Accordingly, it is a principal object of the present invention to provide a fixing device wherein the flickering can be reduced. It is another object of the present invention to provide a fixing device wherein the electric power supply level can be changed to a great number of levels with a small number of waves. According to an aspect of the present invention, there is provided a fixing device comprising a fixing heater for being supplied with an AC voltage to generate heat; control means for variably controlling power of supplied electric energy to the fixing heater, wherein one cyclic period for changing the electric power comprises a plurality of waves, and the one cyclic period including a portion in which an electric power supply phase is changed and a portion in which a number of waves of the electric power supply is controlled.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENT

The preferred embodiments of the present invention will be described in conjunction with the accompanying drawings.

Figure 1:
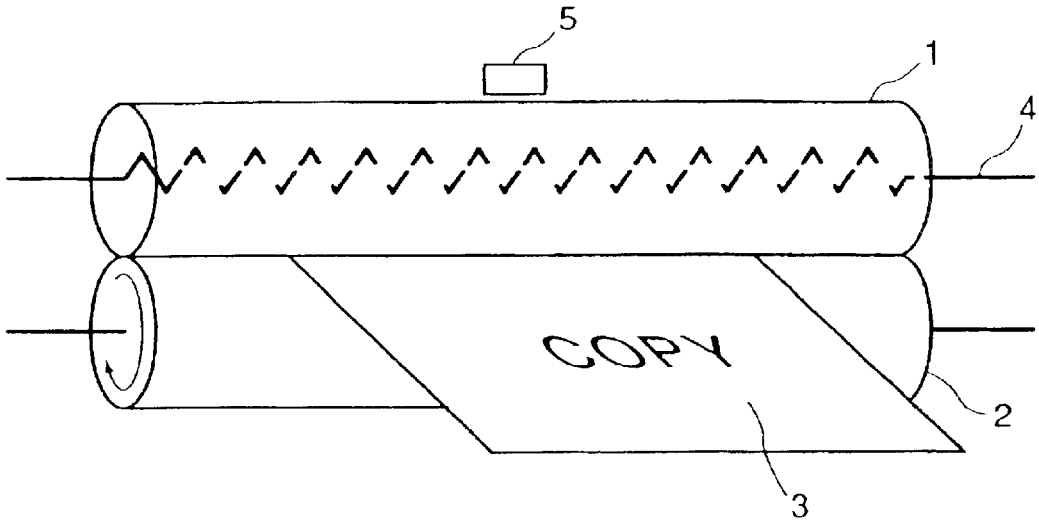
FIG. 1 PRIOR ART
FIG. 1 is a substantial view of a fixing device.
Figure 2:
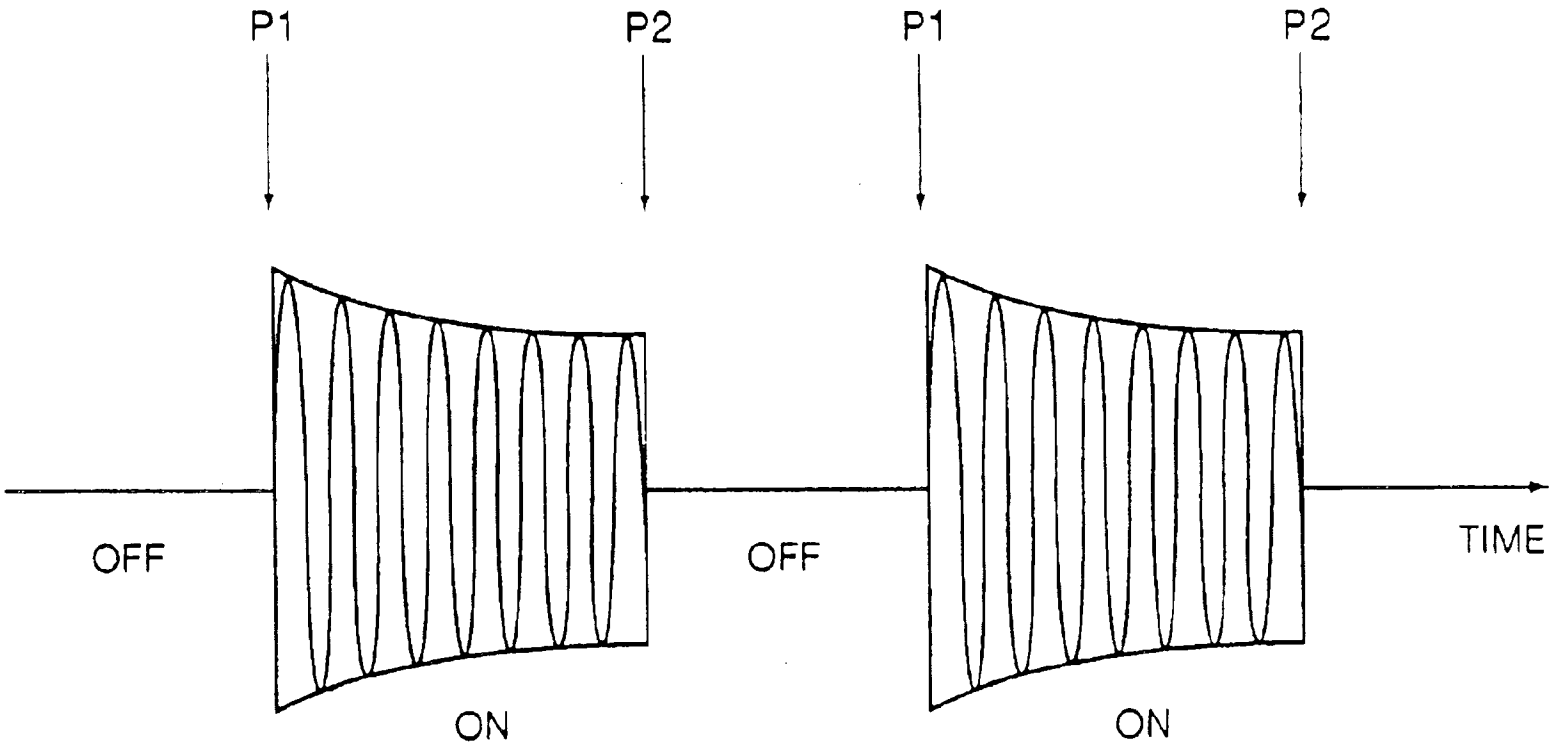
FIG. 2 PRIOR ART
FIG. 2 shows a heater electric power supply current waveform in a conventional ON/OFF control operation for temperature adjustment of the heater roller shown in FIG. 1.
Figure 3:
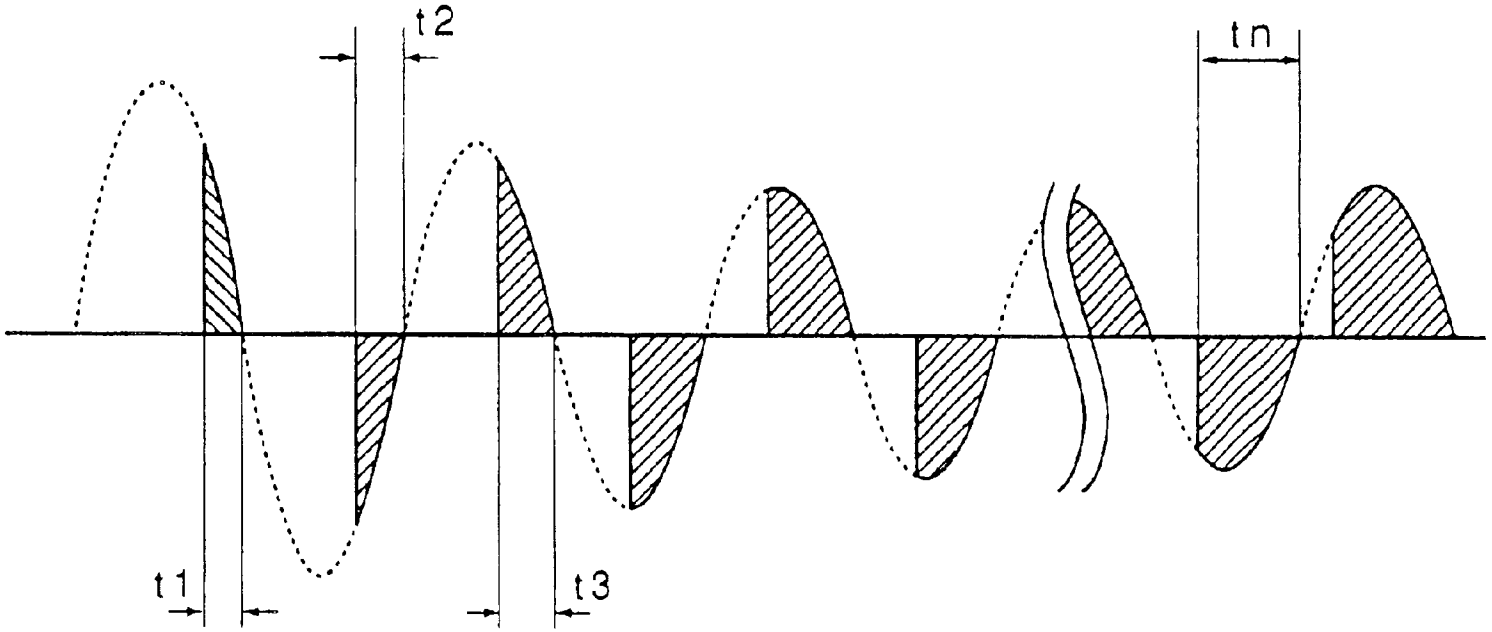
FIG. 3 PRIOR ART
FIG. 3 illustrates electric power supply to the heater in a conventional phase control (conduction angle control).
Figure 4:
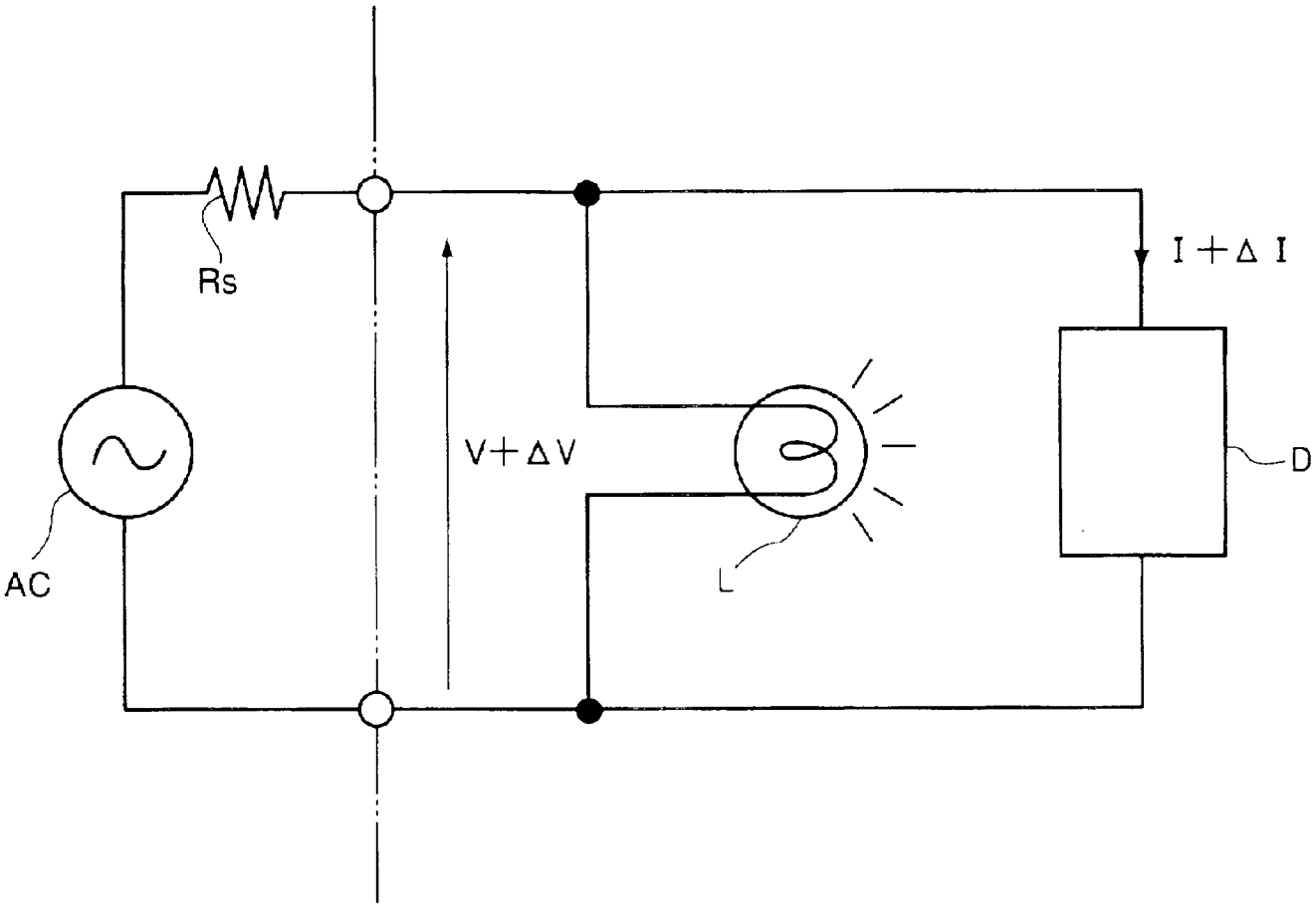
FIG. 4 illustrates a relatively small voltage source impedance Rs as the power source is seen from outside of the voltage source electrical outlet.

The structure shown in FIG. 1 is used in this embodiment.

Figure 5:
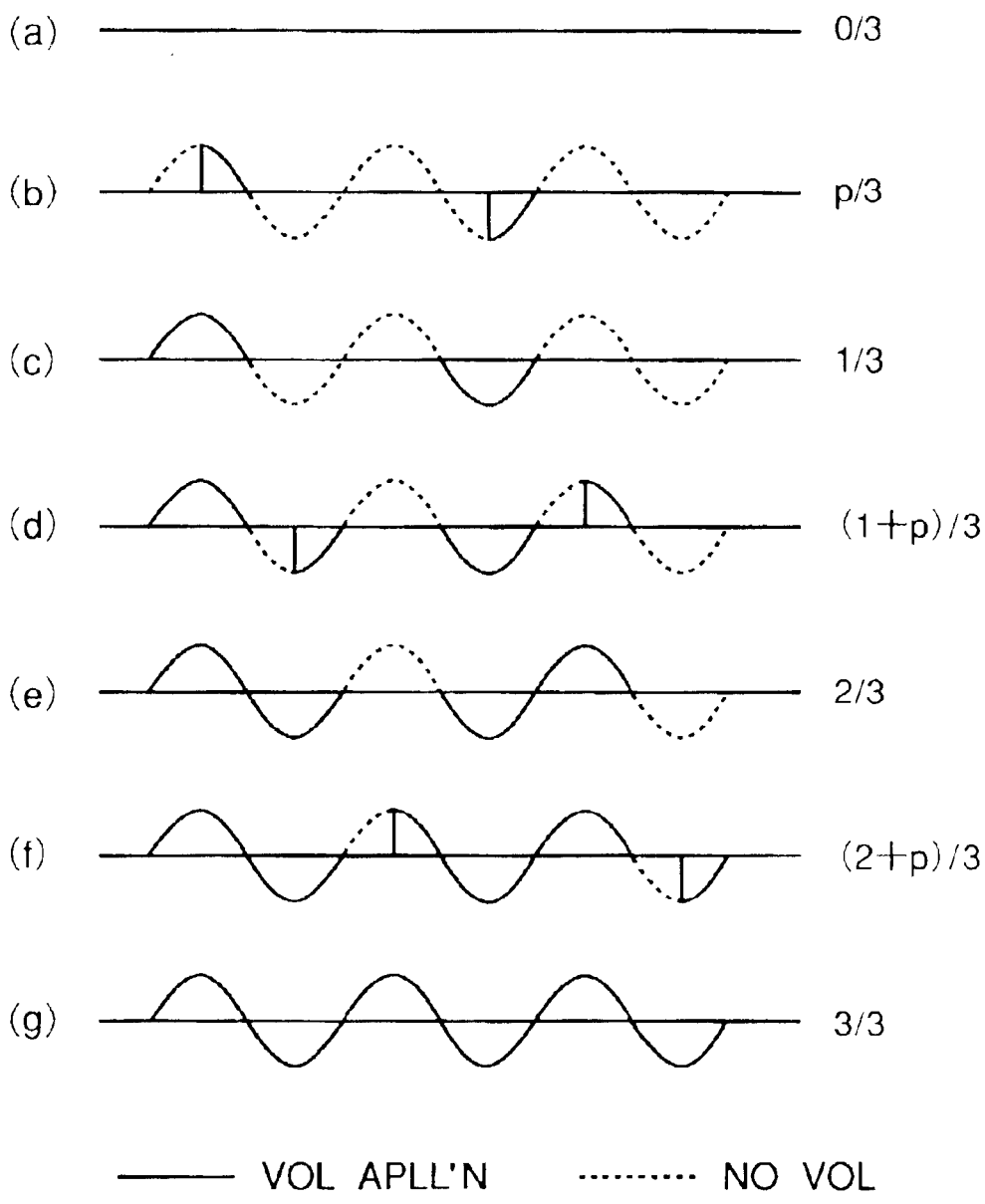
FIG. 5 shows all of the electric power supply patterns in this embodiment.

In this embodiment, a basic unit for which the power of supplied electric energy is variable is constituted by continuous 3 half waves and which forms one period. Among the half waves, only one half wave is subjected to a phase control, and the two half waves are subjected to a wave number control (full power supply or no power supply to each of the half waves). FIG. 5 shows all of the electric power supply patterns. In FIG. 5, a indicates a non-electric power supply pattern. Indicated by b is a pattern (p/3) in which only the phase control half waves in the unit three half waves (one cyclic period of control). Indicated by c is a pattern in which the power is full supplied in half waves (1/3). Similarly, d is a pattern in which the half wave full power and the phase control half wave supply ((1+p)/3); e is a pattern in which the full power is supplied for two half waves out of three half waves (2/3); f is a pattern in which the full power is supplied for two half waves out of three half waves and the rest is phase-controlled ((2+P)/3); g is a pattern of full power supply. Using the seven electric power supply patterns a–g, a continuous electric power control is accomplished.

With such an electric power supply pattern, the phase control portion comes once in three half waves, an amount of contact noise appearing in the high investigation wave current and voltage source line is reduced. Therefore, the capacities of a choke coil and a voltage source line filter which are provided in series with the heater, can be reduced.

For this reason, it is advantages in terms of flickering over a multi-value proportional control disclosed in Japanese Patent Application No.2000237162. This point will be described.

Effective value voltages of each of the electric power supply patterns shown in FIG. 5 will be taken. The electric power supply patterns b, d, f including partial half waves will be considered.

The effective value voltage Vrp/3 of the three half wave phase control p/3 shown in the electric power supply pattern b is expressed as follows:

$$Vr_{p/3}=(1/\sqrt{3})(Vm/\sqrt{2})\sqrt{(1-2t1/T+(1/2\pi)\sin 4\pi t1/T)}$$

In this equation, when $0 \leqq t1<T/2$, $0 \leqq Vrp/3<(1/\sqrt{3})$ Vrms. Where Vrms is an effective value of the total electric power supply pattern g, and Vm is a peak voltage.

In (1+p)/3 waveform of electric power supply pattern d, the effective value $Vr_{(1+p)/3}$ is:

$$Vr_{(1+p)/3}=(1/\sqrt{3})(Vm/\sqrt{2})\sqrt{(2-2t1/T+(1/2\pi)\sin 4\pi t1/T)}$$

When $0 \leqq t1<T/2$, it is (1/v3) $Vrms \leqq Vr_{(1+p)/3}<\sqrt{(2/3)}$ Vrms.

In (2+p)/3 waveform of electric power supply pattern d, the effective value $Vr_{(2+p)/3}$ is:

$$Vr_{(2+p)/3}=(1/\sqrt{3})(Vm/\sqrt{2})\sqrt{(3-2t1/T+(1/2\pi)\sin 4\pi t1/T)}$$

When $0 \leqq t1<T/2$, it is $(1/\sqrt{3})\sqrt{(2/3)}Vrms \leqq Vr_{(2+p)/3} \leqq Vrms$.

By making selection from the seven electric power supply patterns a–g shown in FIG. 5, and t1 is changed in the region of 0 T/2, zero to full levels voltage can be generated.

For example, in t electric power supply patterns b, d, f in FIG. 5, when the phase angle of the partial wave is 90° (the corresponding time t=(cyclic period T)/4), the effective value (effective voltage) is as follows:

a: (0) effective value=0
b: (p/3) effective value=($\sqrt{(1/6)}$) Vrms
c: (1/3) effective value=($\sqrt{(2/6)}$) Vrms
d: (1+p)/3 effective value=($\sqrt{(3/6)}$) Vrms
e: (2/3) effective value=($\sqrt{(4/6)}$) Vrms
f: (2+p)/3 effective value=($\sqrt{(5/6)}$) Vrms
g: (3/3) effective value=Vrms Thus, seven voltage levels (electric power supply patterns a) can be produced including zero voltage. Here, p/3 is based on a phase angle of 90° (t=AC cyclic period T/4).

Figure 6:
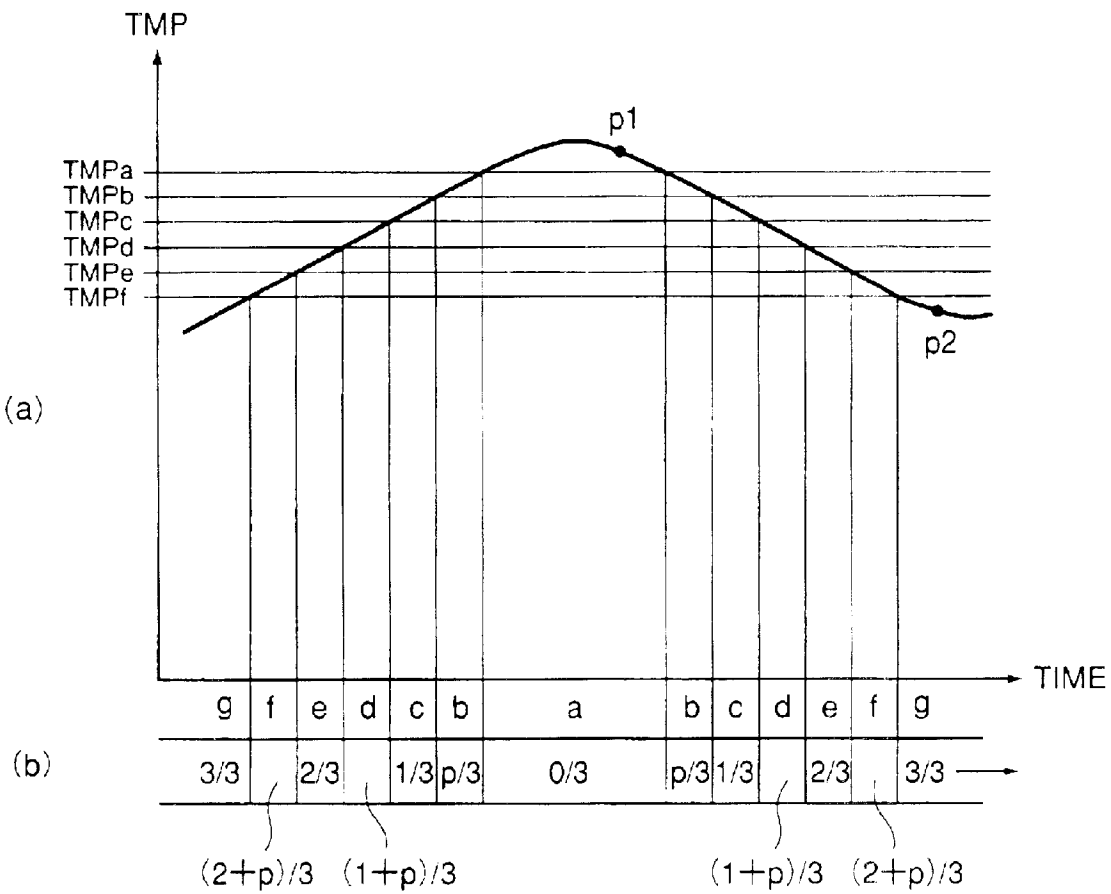
FIG. 6 illustrates a proportional control at seven different levels in this embodiment.

In this embodiment, by using such electric power supply patterns, t four-value control can be expanded to seven-value proportional control, despite the fact that three half wave periods are equally used. Referring to FIG. 6, the description will be made as to application of the control. As shown in FIG. 6, (a), the roller detected temperature level is divided by six thresholds TMPa, TMPb, TMPc, TMPd, TMPe and TMPf (TMPa>TMPb>TMPc>TMPd>TMPe>TMPf). For the resultant seven temperature levels, the electric power supply patterns a, b, c, d, e, f and g are assigned, as shown in FIG. 6, (b), that is, higher temperatures are assigned with lower voltage levels.

More particularly, when the temperature is TMP≧TMPa, the heater is supplied with the voltage having the electric power supply pattern a (no electric power supply (0/3). When TMPa >TMP>TMPb, the heater is supplied with the electric power supply pattern b (p/3). When TMPb >TMP>TMPc, the electric power of the supply pattern c (1/3) is supplied. When TMPc>TMP>TMPd, the electric power supply pattern d of (1+p)/3 is used. When the temperature level satisfies TMPd>TMP>TMPe, the electric power supply pattern e of (2/3) is used, and when TMPe>TMP>TMPf, electric power supply pattern f (2+p))/3 is used. When t temperature becomes lower than or equal to TMPf, the heater is supplied with full power using the electric power supply pattern g of (3/3).

In the case that temperature changes from a point P1 in the highest temperature region to a point P2 in the lowest temperature region, the electric power supply pattern changes in the order of a, b, c, d, e, f and g in accordance with the temperature change. When the temperature changes in the opposite direction, the electric power supply pattern changes in the opposite direction, too.

The change of the temperature of the fixing roller is normally much gradual as compared with the current change relating to flickering, and therefore, the stepwise current change of the effective voltage applied by the electric power supply patterns corresponding to the temperature change is gradual. This is considered sufficiently effective to reduction the flickering value.

Figure 7:
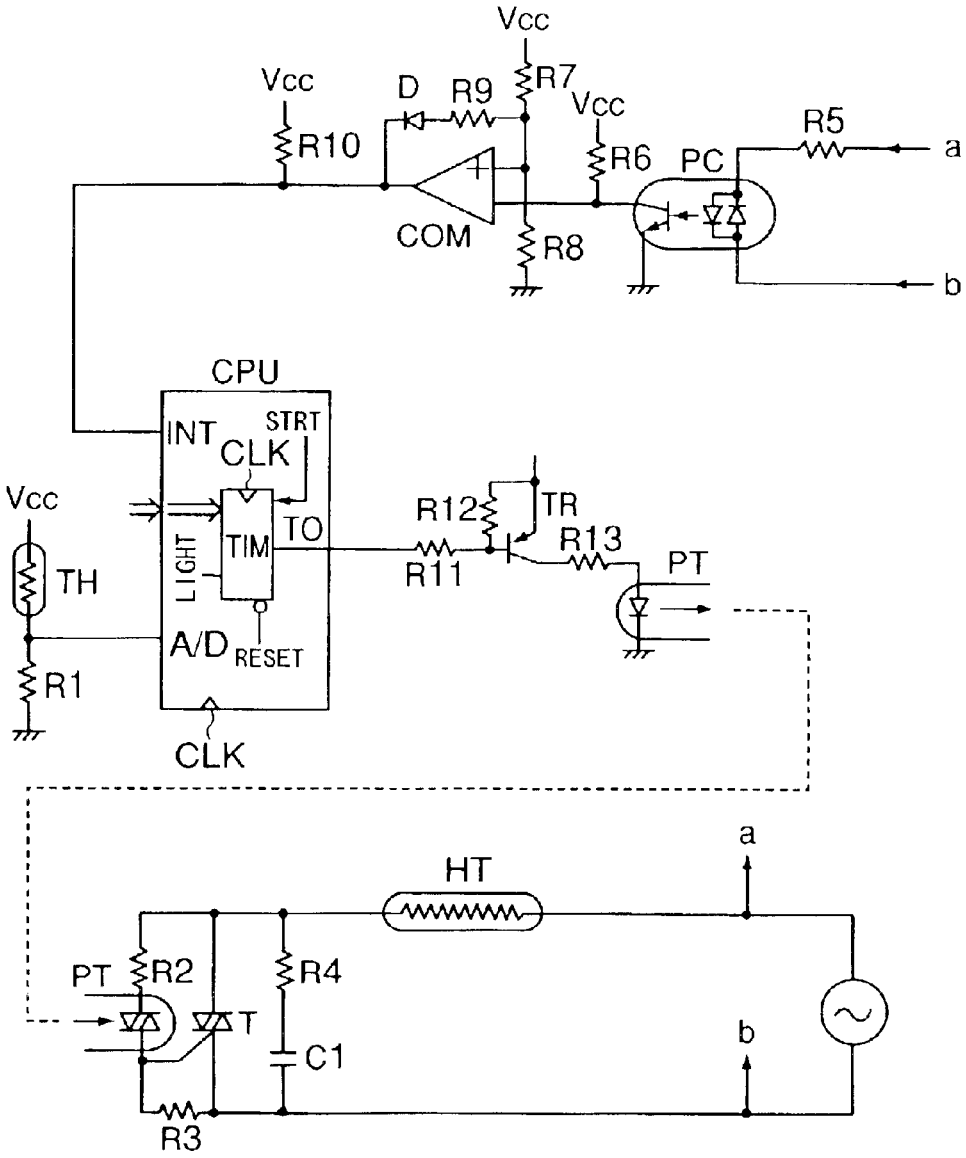
FIG. 7 is a circuit diagram of a system implementing the seven level proportional controlling operation shown in FIG. 6.

FIG. 7 is a circuit diagram for accomplishing the proportional controlling operation using seven levels in this embodiment. Designated by TH in the Figure is a thermister (5 in FIG. 1) for detecting a temperature of a heater roller (1 in FIG. 1). The thermister 5 is connected with a resistance R1, and a partial potential is inputted to an analog input contact A/D of a CPU. The signal supplied to the A/D contact is subjected to an analog/digital conversion and then processed in the CPU. The INT input contact of the CPU is supplied with a zero-cross pulse in relation to the power source voltage. The zero-cross pulse is generated by a comparator COM and a photo-coupler PC which receives an AC voltage inputted thereto from the power source voltage input ends a, b through resistance R5. The zero-cross pulse generation circuit per se is known. In response to a falling of the zero-cross pulse input signal, an interruption routine (which will be described hereinafter) in the CPU is started. Immediately after the falling of the zero-cross signal, an internal delay timer TIM is rest. The output T0 is H level, and a delay timer value t is set and started. The timer output T0 of the delay timer TIM becomes Low when time t elapses after the start. The timer output of the L level functions to generate a heater turn on signal to control the heater HT.

More particularly, when the T0 output is at the H level, a transistor TR is rendered OFF, so that emission side of a photo-TRIAC PT is OFF. A receipt side of the photo-TRIAC PT is also OFF, no gate current flows in t TRIAC T. Therefore, the TRIAC T is in the OFF, and heater HT is not energized. On the contrary, when the timer output T0 is at the LOW level, the operation is opposite to the above-described. More particularly, the transistor TR is ON, and the light emitting diode of the photo-TRIAC PT lights on, and the light receiving side of the photo-TRIAC PT is also ON. Since the light receiving side of the photo-TRIAC PT becomes conductive, the gate of the TRIAC T is supplied with a gate current limited by a resistance R2 or R3. Therefore, the TRIAC T becomes conductive, and the heater HT is supplied with electric energy. A resistance R4 and a capacitor C1 connected in parallel with the TRIAC T constitutes a RC circuit, and it is effective to prevent sponteneous actuation of the TRIAC T when the power source voltage changes abruptly due to an external noise.

Figure 8:
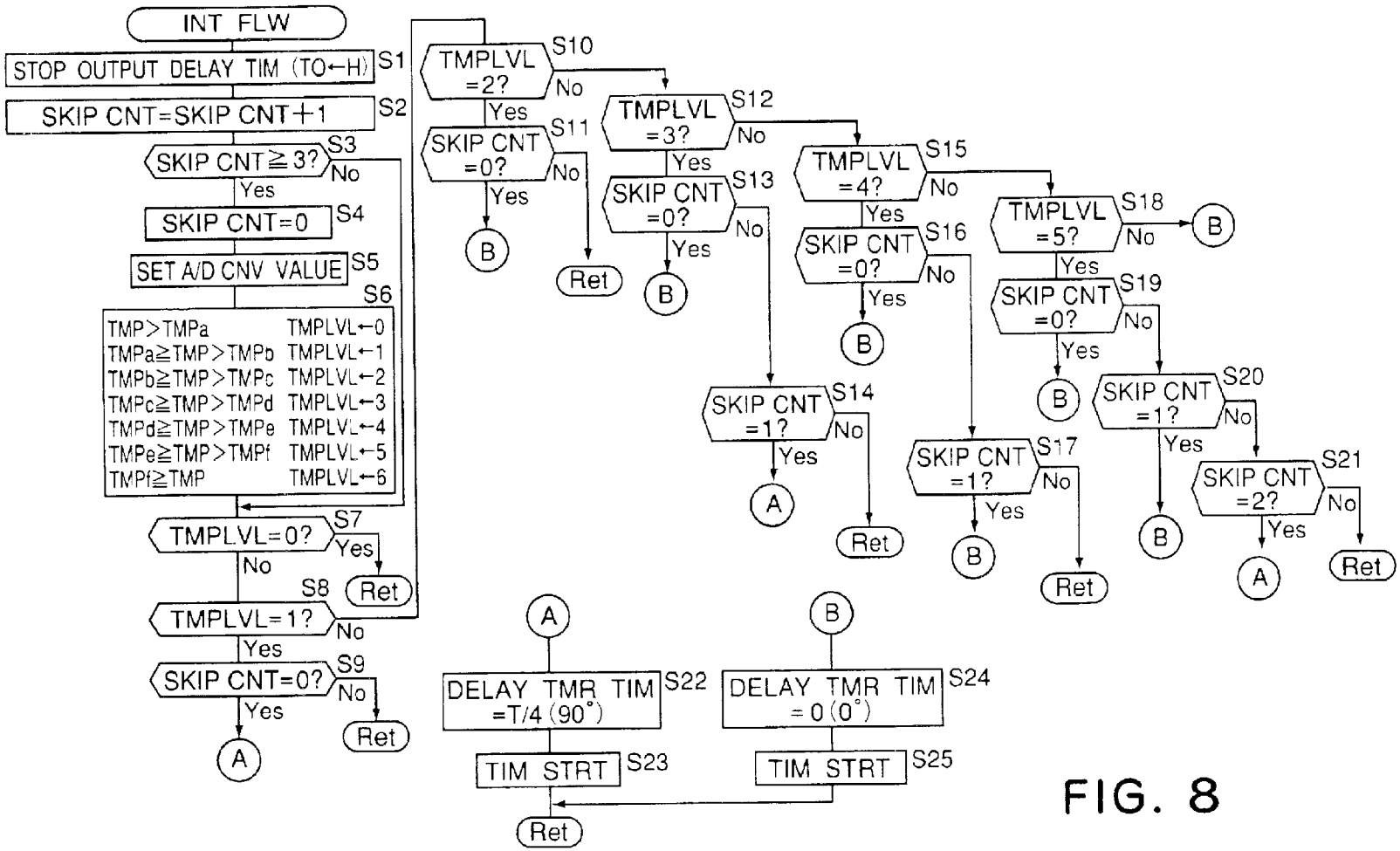
FIG. 8 is a flow chart of process steps of the interruption routine by a CPU shown in FIG. 7.

Referring to FIG. 8 (flow chart), the description will be made as to the process steps of the interruption routine of the CPU in the circuit shown in FIG. 7.

To the interruption input contact INT to the CPU (FIG. 7), a zero-cross pulse in the form of an AC power source voltage, and therefore, for each of the generations of the pulses (here, pulse failings), the processing in the CPU is interrupted, and the flow process shown in FIG. 8 is carried out.

At the start of the interruption process, an output delay timer TIM is stopped (reset) (S1). The output T0 at this time is at H level, and therefore, the emission side of the photo-TRIAC PT is rendered OFF. Therefore, the photo-TRIAC T is in the OFF state, and the heater is light OFF.

Then, a skipping counter is incremented (+1) (S2). The thinning or skipping counter is incremented for each interrupting operation (INT), but is reset to zero when it reaches 2. Namely, the count changes 0, 1, 2,0, 1 . . . By monitoring the counts, the one of the three consecutive half waves which is the current object of control can be known.

In the next discrimination step S3, the discrimination is made as to whether the count of the counter added immediately before, has reached 3 or not. If so, it is reset to the initial level 0, and if not, the operation goes to step S7. Each time the counter is reset to 0, that is, at a rate of once three interruptions, the partial potential of the roller temperature thermister TH is taken after A/D conversion (S5). In the next process, temperature level data is set correspondingly to the taken temperature value. This corresponds to the temperature threshold shown in FIG. 6. Here, if the temperature satisfies TMP>TMPa, the temperature level data is set to 0.

If TMPa≧TMP>TMPb, it is set to 1. Similar discriminations and settings are carried out, and finally, if TMP≦TMPf, 6 is set. Thus, one of temperature level (TMPLVL) data 0 6 is set in accordance with the detected temperature value (temperature region) in this process.

At the next discrimination step S7, the discrimination is made as to whether or not the temperature level data is 0, that is, whether or not the roller temperature exceeds TMPa. If it exceeds TMPa, the operation goes to No side, and then nothing is done (the heater is kept unengergized), and the operation returns. If it is not more than TMPa, the operation proceeds to a discrimination step S8.

At discrimination step S8, if the TMPLVL data is 1 (TMPa≧TMP>TMPb), the discrimination is first made as to whether or not the skipping counter is 0 (S9). If so, a proper timer value T/4 (the time required for the phase angle of 90° to be reached) (S22), and the timer TIM is started (S23). The timer TIM switches the output T0 to the L level from the H level T/4 after the start. In this manner, the heater energizing time control of phase 90° is carried out when the count of the skipping counter is 0.

When the count of the skipping counter is not 0 at said discrimination step S9, nothing is done, and the operation returns. As a result, the timer output T0 remains unchanged (keeps H level), and therefore, the heater is in the OFF state. Therefore, in the first one of the half waves in which the counts of the skipping counters are 0, the heater is energized with 90° phase, and in the subsequent periods in which the counts of the skipping counter are 1 or 2, the heater is not energized. This corresponds to the electric power supply pattern b in FIG. 5.

The operation returns to step S8, and if the TMPLVL data indicate 2, the operation goes to No side, and in the subsequent discrimination step S10, it goes to Yes side. If the skipping counter is 0 in the subsequent discrimination step S11, the operation goes to Yes side, and 0 is set in the delay timer TIM (S24). Then, as soon as the timer starts (S25), the output T0 switches from the H level to the L level, so that heater is actuated.

If the result of discrimination at said discrimination step S11 is negative, that is, the count is 1 or 2, nothing is done, and the operation returns. Therefore, the heater remains unactuated. In this manner, the electric power is supplied in the first half wave, and not supplied in the subsequent half waves. This corresponds to the electric power supply pattern c shown in FIG. 5.

When TMPLVL data indicate 3, similar processes are executed at discrimination steps S12, S13, S14, so that heater is controlled with the electric power supply pattern d.

When TMPLVL data indicate 4, similar processes are executed at discrimination steps S15, S16, S17, so that heater is controlled with the electric power supply patter e.

When TMPLVL data indicate 5, similar processes are executed at discrimination steps S18, S19, S20, S21, so that heater is controlled with the electric power supply patter f.

When TMPLVL data indicate 6, the operation branches out to the No side in the discrimination step S18, so that steps S24, S25 are executed irrespective of the count of counter. As a result, the electric power supply pattern g can be accomplished.

By repeating the above-described operations, the heater is actuated the seven level (value) proportional control responsive to the temperature range shown in FIG. 6, according to this embodiment. These operation are controlled by software.

Figure 9:
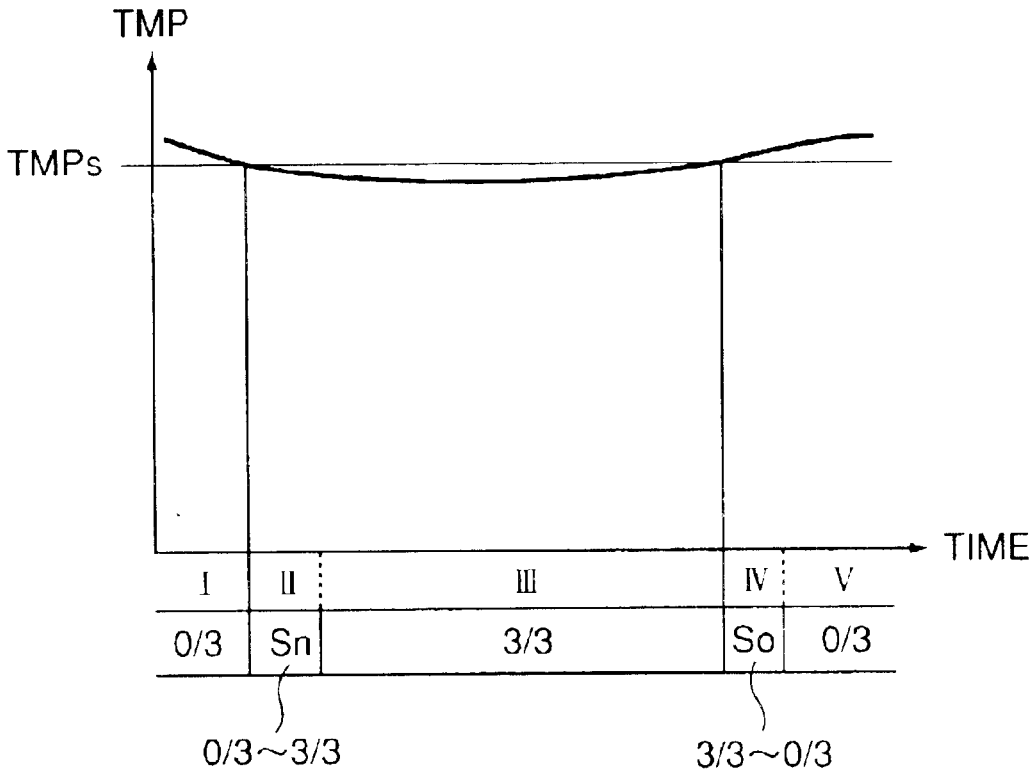
FIG. 9 illustrates another embodiment of the present invention.
Figure 10:
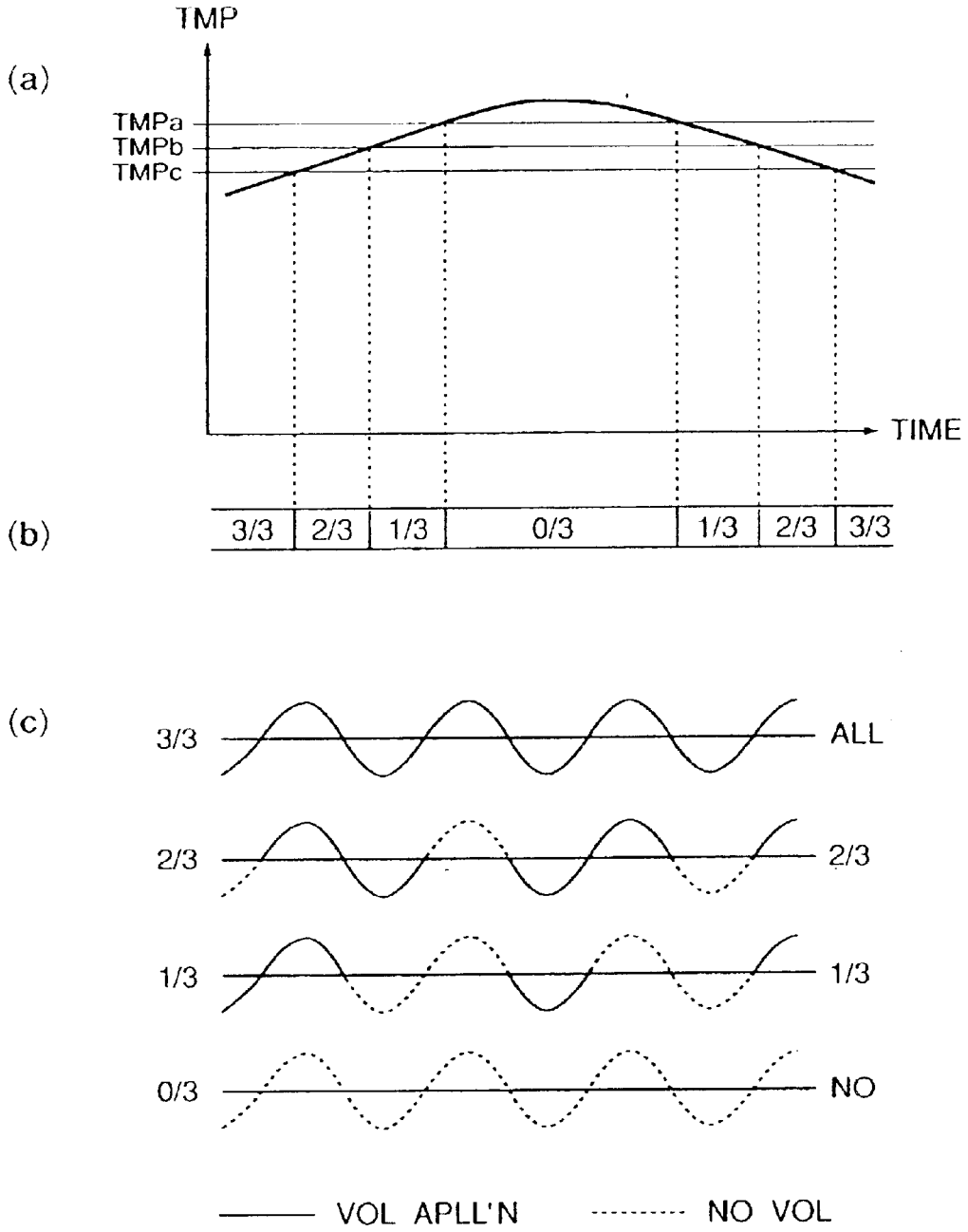
FIG. 10 PRIOR ART
FIG. 10 illustrates a basic operation of a multi-level proportional control.

Referring to FIG. 9, another embodiment of the present invention will be described. In the foregoing embodiment, multi-value proportional is used. In this embodiment, the electric power supply pattern which is a combination of the wave number control and the phase control shown for example in FIG. 5 may be used for the ON/OFF control (bi-level control) of the heater. In this case, when the roller temperature is higher than a target temperature TMPs (temperature threshold), the electric power supply pattern an of non-electric power supply 0/3 is selected for the heater. When the temperature is lower than TMPs, the heater, in a conventional bi-level control system, is supplied with the full power. However, in this embodiment, the current is gradually increased using seven electric power supply patterns shown in FIG. 5, which is a combination of a wave number control and a phase control for a predetermined period Sn immediately after start of actuation. When the roller temperature becomes higher than a target temperature TMPs, the current is gradually decreased to the state of electric power supply 0/3, using the seven electric power supply patterns shown in FIG. 5 for a predetermined period S0 immediately after that.

According to the present invention, the phase control and the wave number control are combined in a segmentalized manner so that current can be more finely set in a cyclic period. By doing so, the flickering can be further decreased, and generations of the harmonic current and noise at the power source line contact can be further reduced.

In the foregoing, the description has been made as to the preferred embodiments of the present invention. The number of unit waves may be four or larger. By doing so, the flickering can be further reduced. As compared with a general phase control, the generations of the harmonic current and the noise at the power source line contact can be reduced.

While the invention has been described with reference to the structures disclosed herein, it is not confined to the details set forth and this application is intended to cover such modifications or changes as may come within the purpose of the improvements or the scope of the following claims.

What is claimed is:

1. A fixing apparatus comprising:

a heater for being supplied with an AC voltage to generate heat;

a fixing member for applying heat from said heater to an unfixed image;

a detecting member for detecting a temperature of said fixing member; and selecting means for selecting an electric power supply pattern from predetermined electric power supply patterns for supplying electric power to said heater on the basis of an output of said detecting member;

wherein a period of said predetermined electric power supply patterns corresponds to a time duration corresponding to a plurality of half-waves, and said predetermined electric power supply patterns are provided by incrementing or decrementing electric power supply time duration by quarter-wave which is one half of the half-wave.

2. A fixing apparatus according to claim 1, wherein said predetermined electric power supply patterns include an electric power supply pattern having only electric power supply half-waves the number of which is controlled.

3. A fixing apparatus according to claim 1, wherein only one half-wave in the plurality of half-waves is included in the period.

4. A fixing apparatus according to claim 3, wherein two half-waves in the plurality of half-waves is included in the period.

5. A fixing apparatus according to claim 1, wherein said patterns include an electric power supply pattern comprising an on-state half-wave and an on-state quarter wave.

* * * * *

UNITED STATES PATENT AND TRADEMARK OFFICE

CERTIFICATE OF CORRECTION

PATENT NO. : 6,853,818 B2
DATED : February 8, 2005
INVENTOR(S) : Yoshiaki Nishida It is certified that error appears in the above-identified patent and that said Letters Patent is hereby corrected as shown below:

Column 1,
Line 35, “outside” should read -- outside of --.

Column 2,
Line 25, “½,” should read -- 1/3, --.
Line 28, “stepwisely” should read -- stepwise --.
Line 29, “pattern.” should read -- patterns. --.
Line 34, “tol” should read -- to --.

Column 3,
Line 19, “EMBODIMENT” should read -- EMBODIMENTS --.
Line 52, “advantages” should read -- advantageous --.
Line 54, “Application No. 2000237162.” should read -- Application No. 2000-237162. --.

Column 4,
Line 65, “much” should read -- more --.

Column 5,
Line 2, “reduction.” should read -- reduction of --.
Line 44, “sponteneous” should read -- spontaneous --.
Line 52, “failings),” should read -- fallings), --.

Column 6,
Line 19, “unengergized),” should read -- unenergized), --.
Line 61, “patter e.” should read -- pattern e. --.
Line 64, “patter f.” should read -- pattern f. --.

Column 7,
Line 6, “operation” should read -- operations --.
Line 16, “pattern an” should read -- pattern of an --.
Line 17, “of” should be deleted.

UNITED STATES PATENT AND TRADEMARK OFFICE

CERTIFICATE OF CORRECTION

PATENT NO. : 6,853,818 B2
DATED : February 8, 2005
INVENTOR(S) : Yoshiaki Nishida It is certified that error appears in the above-identified patent and that said Letters Patent is hereby corrected as shown below:

Column 8,
Line 25, "quarter-wave" should read -- a quarter-wave --.
Line 36, "is" should read -- are --.
Line 40, "quarter wave." should read -- quarter-wave. --.

Signed and Sealed this

Thirty-first Day of May, 2005

JON W. DUDAS
*Director of the United States Patent and Trademark Office*